US005292352A

United States Patent [19]

Rudolf et al.

[11] Patent Number: 5,292,352

[45] Date of Patent: Mar. 8, 1994

[54] METHOD FOR GRINDING PLASTICS OR GLASS

[75] Inventors: Boris E. Rudolf, Stuttgart; Horst Moissl, Nürtingen, both of Fed. Rep. of Germany

[73] Assignee: C. & E. Fein GmbH & Co., Stuttgart, Fed. Rep. of Germany

[21] Appl. No.: 923,296

[22] Filed: Jul. 31, 1992

[30] Foreign Application Priority Data

Aug. 3, 1991 [DE] Fed. Rep. of Germany ..... 4125795

[51] Int. Cl.[5] ..... B24B 29/02

[52] U.S. Cl. ..... 51/283 R; 51/273

[58] Field of Search ..... 51/283 R, 170 R, 170 MT, 51/170 TL, 180, 273, 281 R

[56] References Cited

U.S. PATENT DOCUMENTS

| | | | |
|---|---|---|---|
| 2,828,587 | 4/1958 | Miller | 51/180 |
| 3,230,672 | 1/1966 | Anthon . | |
| 3,447,267 | 6/1969 | Kelber . | |
| 4,322,921 | 4/1982 | Maier | 51/170 MT |
| 4,905,420 | 3/1990 | Flachenecker et al. | 51/170 R |
| 4,920,702 | 5/1990 | Kloss | 51/170 R |
| 4,969,914 | 11/1990 | Toshiaki Ikegara . | |
| 5,056,268 | 10/1991 | Wolff | 51/170 MT |

FOREIGN PATENT DOCUMENTS

| | | |
|---|---|---|
| 483189 | 7/1928 | Fed. Rep. of Germany . |
| 1994278 | 5/1968 | Fed. Rep. of Germany . |
| 2318426 | 4/1973 | Fed. Rep. of Germany . |

*Primary Examiner*—Robert A. Rose
*Attorney, Agent, or Firm*—Barry R. Lipsitz

[57] ABSTRACT

The invention proposes a method for grinding plastics or glass, in particular for grinding acrylic glass, where a mechanically driven grinding tool is moved across a surface to be finished (44). Grinding is effected by a dry process, without any liquid working agent, the grinding tool performing an orbital movement, or oscillating about a fixed rotary axis at high frequencies, while the grinding dust is extracted from the marginal area. The grinding tool comprises a closed abrasive with resiliently embedded abrasive grains, a plurality of the resiliently embedded abrasive grains having, preferably, level front surfaces which are delimited by relatively sharp edges at the transition to their lateral surfaces, the greatest part of the front surfaces being oriented to extend substantially in parallel to the surface to be worked (44). The method enables plastic and glass surfaces to be micro-finished to a particularly high grade (FIG. 1).

10 Claims, 3 Drawing Sheets

METHOD FOR GRINDING PLASTICS OR GLASS

The present invention relates to a method for grinding plastics or glass, in particular for grinding acrylic glass, where a mechanically driven grinding tool is moved across a surface to be finished.

According to conventional methods, micro-finishing of plastic or glass surfaces is always effected by wet processes, using a liquid working agent.

For this purpose, a polishing paste is applied on the surface to be finished, and the finishing operation is then carried out with the aid of a mechanically driven polishing wheel, the polishing paste being mixed with a liquid agent, such as water.

This method is very complex and expensive, since a continuous supply of liquid is required if scoring and grinding marks on the surface to be worked are to be avoided. Further, the constant contact with the liquid working agent, with the polishing paste and particles removed from the material suspended therein, is found to be extremely disagreeable.

In surface-grinding of transparent materials, which are to be worked to an optical grade, wet polishing presents still another disadvantage. Given the fact that during grinding and/or polishing vision is heavily impaired due to the polishing paste and abrasion material, the surface being worked must be rinsed from time to time in order to enable the result of the grinding operation to be checked and the quality of the surface to be assessed. So, there is always a risk, in particular when mechanically operated tools are used, that parts of the surface may be ground excessively which would have a detrimental effect.

From U.S. Pat. No. 3,230,672, an abrasive has been known which permits surfaces to be micro-finished without taking recourse to a polishing paste. In this case, abrasive grains are embedded resiliently in a carrier material. The abrasive grains have largely level front surfaces, which are delimited by relatively sharp edges at the transition to their lateral surfaces. A special production method ensures that the greatest part of the front surfaces is oriented in such a way as to extend approximately in parallel to the surface to be worked. The grinding or polishing process, therefore, is mainly effected through the sharp edges of the front surfaces, which results in an improved surface quality, there being no sharp-edged points of the abrasive grains projecting in the direction of the surface to be worked. The parallel alignment of the front edges of the abrasive grains relative to the surface to be worked is supported by the fact that the grains are embedded resiliently in the carrier material.

However, due to the constant generation of abrasion material, micro-finishing of glass or plastic surfaces to an optical grade still is possible only by wet processes, even with such an abrasive.

Now, it is the object of the present invention to propose a method for grinding or polishing plastics or glass which, while eliminating the disadvantages of the wet grinding processes, guarantees a high surface quality.

The invention achieves this object by the fact that a mechanically driven grinding tool is moved across a surface to be worked, that grinding is effected by a dry process, without any liquid working agent, that the grinding tool performs an orbital movement, or oscillates about a fixed rotary axis at high frequencies, while the grinding dust is extracted from the marginal area, and that the grinding tool comprises a closed abrasive with resiliently embedded abrasive grains.

The method according to the invention permits plastic or glass surfaces to be micro-finished to optical grades by a dry process.

According to the invention, the grinding tool performs an orbital or oscillating movement about a fixed rotary axis at high frequencies. This avoids working in a preferred working direction, which is encountered with vibrating grinders, and permits uniform finishing of the surface to be worked.

Further, numerous trials have shown that conventional grinding devices, where the grinding dust is extracted through openings in the grinding surface, are not suited for dry processes. A closed abrasive, free from suction openings, does away with all the problems encountered at the edges of the suction openings of conventional grinders. It also avoids the formation of projections at the edges of suction openings which may be produced during the working operation by heavy mechanical stresses in the neighborhood of the suction openings. Moreover, the method according to the invention also avoids punching residues, which may be left at the edges of suction openings in the bottom of conventional grinders and which may impair the grinding quality. At the same time, fraying of the grinding wheel around the suction openings is also avoided. According to the invention, the grinding dust produced during the finishing operation is extracted from the marginal areas of the grinding tool. The effective extraction simultaneously has a cooling effect for the grinding surface—an aspect which is of particular significance when working acrylic glass, because of its temperature-sensitivity. The use of a grinder with an effective marginal exhaust system, therefore, avoids the disadvantages connected with of the removal of dust through the bottom.

According to the invention, it has further been found that it is necessary to use an abrasive composition where the abrasive grains are resiliently embedded. The fact that the abrasive grains are resiliently embedded avoids the formation of grinding marks through sharp-edged projecting abrasive grains, the latter being in a position to align themselves to a certain degree during the grinding process so that no sharp points will project in the direction of the surface to be worked.

Generally, the procedural steps according to the invention enable plastic or glass surfaces to be micro-finished to an optical grade.

This results in considerable savings in time and cost for re-finishing operations on rounded acrylic glass panes of the type used, for example, in jet-fighter cockpits. The acrylic glass surfaces of jet fighters may be scratched in operation by dirt particles, insects, or the like. Especially when jet fighters start at short intervals one after the other, dust, sand and dirt particles are whirled up by the preceding aircraft and may hit upon and damage the next following aircraft. The resulting scratches and surface marks must be removed from time to time, the demands placed on the non-distorting properties of the panes being of course extremely high in this case.

Conventionally, panes of this type were re-finished manually by wet grinding. Due to the necessary accuracy, it was heretofore possible in this way to remove faults with depths of up to approximately 0.2 to 0.3 mm maximally. Since the requirement to achieve non-distorting properties makes it necessary to uniformly grind the entire surface every time faults are to be removed, the substantial input in time and labor made the removal of major faults by manual processes uneconomical so that one preferred to exchange the whole cockpit cover.

The method according to the invention now enables faults of depths of more than 1 mm to be evened out to a high quality grade by a dry process, and this much more quickly and in a cost-saving way.

Whenever heretofore the inside of a cockpit was damaged, the entire cockpit cover had to be removed from the aircraft because performing wet processes in the cockpit area was of course impossible due to the delicate electronic instruments. With the method according to the invention it is now possible in many cases to avoid the extraordinarily time-consuming and costly removal and re-installation of the cockpit cover. And it is now also possible to carry out rapid emergency repairs, which improves the availability of the aircraft when there is no time for exchanging the cockpit hood, or when the necessary spare parts are not at hand.

According to an advantageous further improvement of the method, the resiliently embedded abrasive grains have substantially level front surface which are delimited by relatively sharp edges at the transition to their lateral surfaces, the greatest part of the front surfaces being oriented to extend substantially in parallel to the surface to be worked.

This further reduces the risk of scratches being formed during the finishing operation, as there are no sharp points of the abrasive grains projecting in the direction of the surface to be worked.

Especially when working acrylic glass panes of cockpit covers, additional process parameters have to be adhered to. The basic material of such cockpit covers being pre-stressed in a specific way in order to obtain the required strength, there is a risk during dry grinding that stress cracks may form when a given threshold temperature is exceeded. Especially, optical faults may occur below the working surface as a result of stresses being released.

An advantageous further improvement of the method according to the invention provides that in working acrylic glass the grinding speed, i.e. the average speed of the abrasive grains, is selected to be in the range of approximately 2 to 10 m per second, and the contact pressure is limited in such a way as to not exceed a surface temperature of approximately 50° Centigrade. This provides sufficient security that stresses will not be released and/or stress cracks will be avoided.

For working larger acrylic glass surfaces, eccentric grinders, which are driven to perform an orbital movement at a speed of approximately 2000 to 10000 l/min., preferably of approximately 4000 to 8000 l/min. and which are provided with a marginal grinding dust exhaust system, are particularly well suited. The eccentric throw preferably is equal to approximately 1 to 1.5 mm.

One obtains in this manner a particularly high quality grade when working larger acrylic glass surfaces.

In contrast, when working marginal areas and corners that are difficult to access, grinding tools are preferred which comprise abrasive carriers having at least one corner area and performing an oscillating movement at a frequency of approximately 10000 to 25000 l/min. about an axis fixed to the device. Here again, the grinding dust must be removed effectively by a corresponding marginal exhaust system.

It has been found that a triangular shape of the abrasive carrier is particularly convenient under handling aspects.

According to a preferred further development of the method, the abrasive projects over the edges of the abrasive carrier. This has the effect that the abrasive is bent off a little in upward direction at the edges of the abrasive carrier so that on the one hand the abrasive is prevented from getting detached from the carrier, while on the other hand the marginal area of the grinder can also be employed for finishing without a risk that the surface to be worked may be damaged by sharp edges.

It is understood that the features that have been mentioned before and that will be described hereafter may be used not only in the stated combinations, but also in any other combination or each alone, without departing from the scope of the present invention.

Some preferred embodiments of the invention will now be described in more detail with reference to the drawing in which FIG. 1 shows an elevation of a jet-fighter cockpit with an acrylic glass pane in hood shape, which can be re-finished using the method according to the invention;

Figure 1:
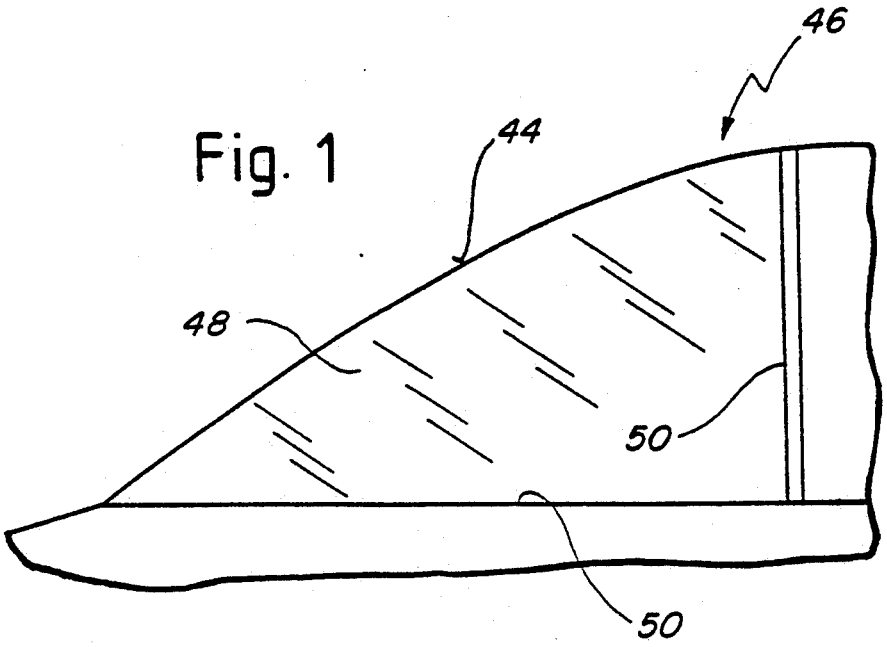

In FIG. 1, a cockpit which is covered by a hood-shaped acrylic glass pane 48 is indicated generally by reference numeral 46. The marginal and corner areas are indicated by 50, while the surface to be worked, which may be the inside or the outside of the cover, is indicated by 44.

Figure 2:
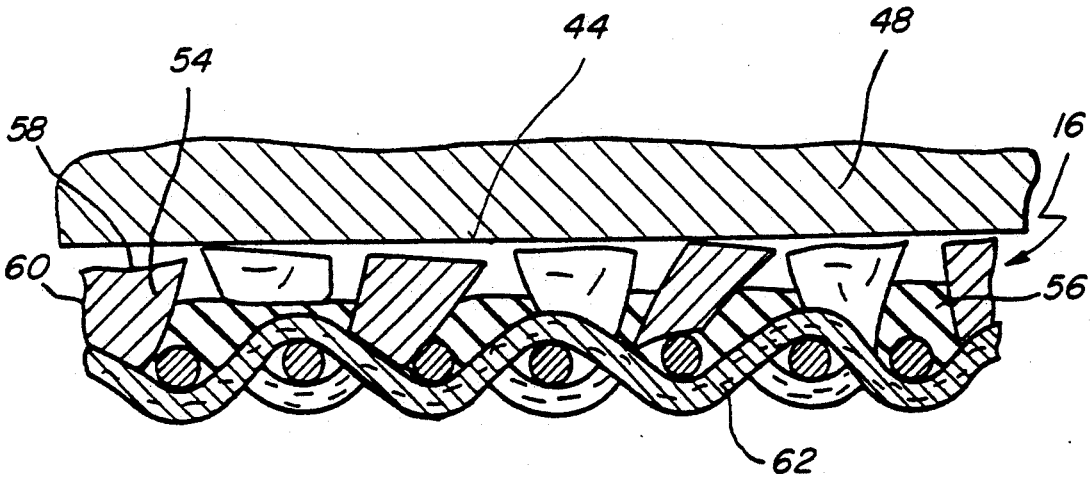
FIG. 2 shows an enlarged, diagrammatic representation of an abrasive according to the invention, in contact with the surface of the acrylic glass pane according to FIG. 1.

FIG. 2 shows the structure of an abrasive which is preferred for the method according to the invention. Abrasive grains 54 are embedded in a resilient bonding agent, for example latex, on an abrasive carrier 62. The abrasive grains 54 have substantially level front surfaces 58 which are delimited by relatively sharp edges at the transition to their lateral surfaces 60, the greatest part of the front surfaces 58 being oriented to extend approximately in parallel to the surface to be worked 44. The latex layer 56 is sufficiently resilient to support the parallel alignment of the front surfaces 58 during the grinding process.

Figure 3:
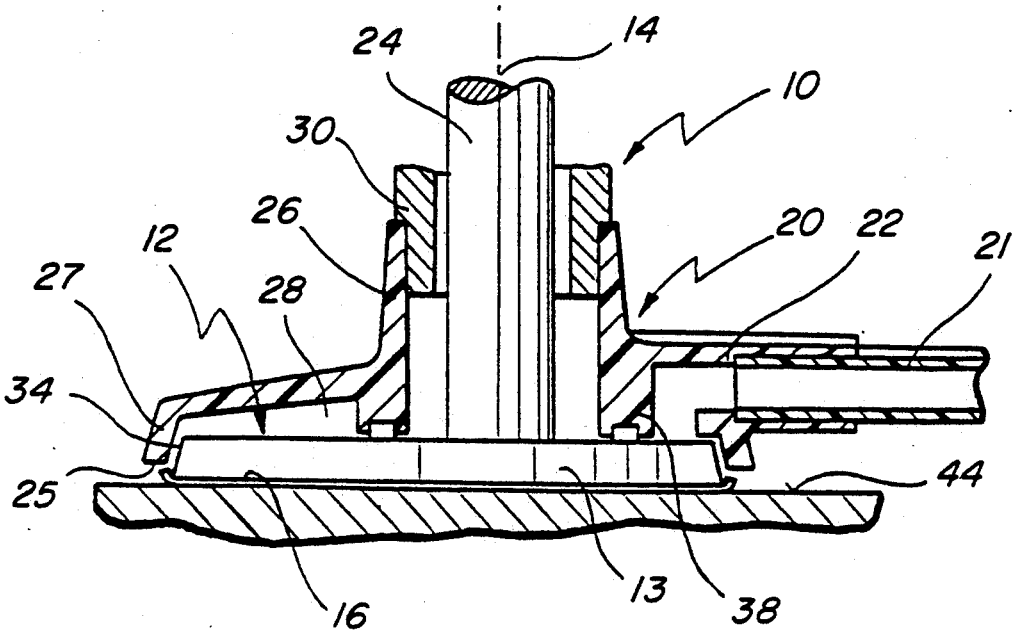
FIG. 3 shows a section through part of the lower area of a grinder suited for finishing the corner and marginal areas of the acrylic glass pane according to FIG. 1.

FIG. 3 shows a section through part of the lower area of a grinder with a suction hood, which is particularly well suited for working the marginal and corner areas 50 of the acrylic glass pane 48.

The grinder, which is designated generally by reference numeral 10, comprises a drive housing 30 accommodating a rocking shaft 24 setting a grinding tool 12 into an oscillating movement about a rocking axis 14 fixed to the device. The free end of the rocking shaft 24 carries the grinding tool, indicated generally by 12. The grinding tool 12 comprises a triangular abrasive carrier 13 with an abrasive 16 according to FIG. 2 fixed thereon. The grinding tool 12 is enclosed by a suction hood designated generally by reference numeral 20. The suction hood 20 comprises a central connecting sleeve 26, which slightly tapers on its outside and which terminates in the hood 20 by a cylindrical extension 38 extending right to the grinding tool 12. The connecting sleeve 26 is fitted on the flange-like end of the drive housing 30.

Figure 4:
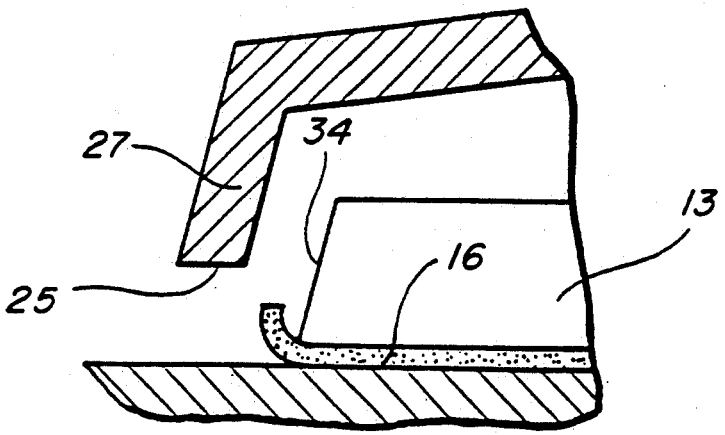
FIG. 4 shows an enlarged partial view of the marginal area of the grinder according to FIG. 3.

The outer shape of the suction hood 20 is adapted to the triangular shape of the grinding tool 12. The suction hood 20 comprises three lateral faces 27 of slightly convex shape, which are arranged symmetrically relative to the connection sleeve and which form an external cover for the lateral faces 34 of the grinder 12 and have their end faces 25 slightly set off from the grinding surface so that a gap is formed between the end faces 25 and the surface to be worked 44 across which the grinding tool 12 is moved (FIG. 4). This prevents the end faces 25 from getting into contact with the surface to be worked 44, without impairing the suction effect.

According to FIG. 4, the abrasive 16 projects a little over the edges of the abrasive carrier 13, preferably by an amount of 1 to 2 mm. This has the effect that the edges of the abrasive 16 are bent off a little in upward direction so that no sharp edges can be formed by the lateral faces 34 of the abrasive carrier.

The suction hood 20 comprises a suction chamber 28 extending from a suction pipe 22, which ends laterally between two corners of the suction hood 20, to the opposite corner. The cross-section of the suction chamber 28 tapers from the suction pipe 22 toward the opposite corner.

This improves the suction efficiency, in particular in the corner area opposite the suction pipe 22—an effect which is particularly advantageous because of the greater amount of grinding dust produced when greater use is made of the corner area of the device, in order to prevent scoring and the formation of grinding marks. In the suction pipe 22, a male pipe 21 is fitted which is connected to a suction device not shown in the drawing.

The grinder according to FIG. 3 is particularly well suited for working the corner areas 52 and the marginal areas 50 of the acrylic glass pane 48 according to FIG. 1.

The oscillation frequency is set for this purpose to a range of between 10000 and 25000 times per minute, the pivot angle being maximally equal to approximately 7°. One obtains in this way an average speed of the abrasive grains of approximately 2 to 10 m per second. The contact pressure on the surface to be worked 44 is limited to a value which ensures that the average surface temperature will not exceed approximately 50° Centigrade during dry finishing.

Figure 5:
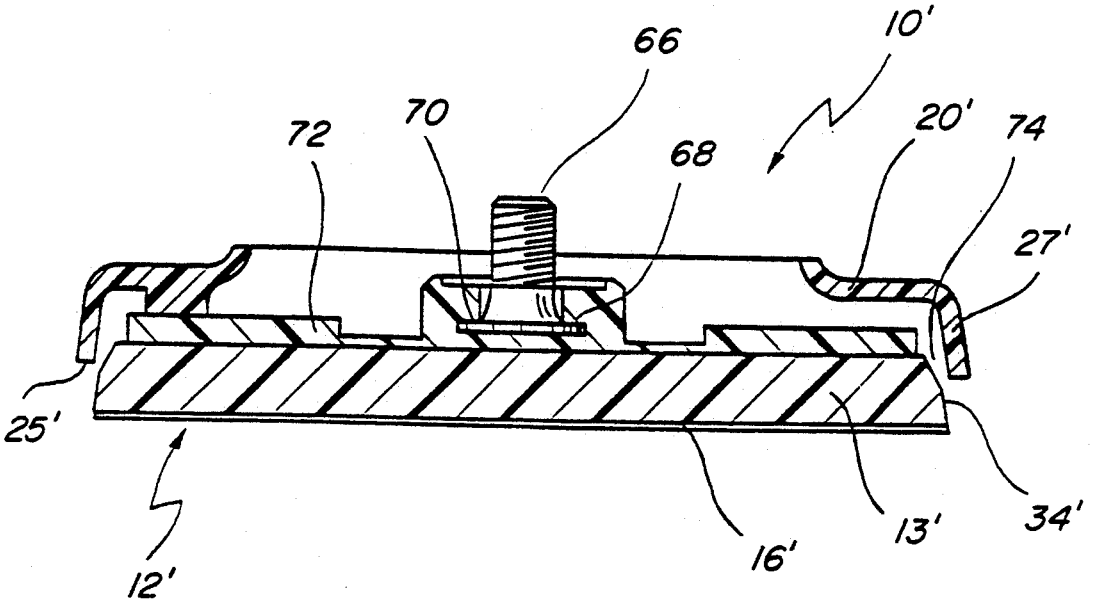
FIG. 5 shows a section through part of the lower area of a grinder suited for finishing larger surfaces of the acrylic glass pane according to FIG. 1.

The remaining areas of the acrylic glass pane 48 are worked, preferably, by the cross-grinding process using an eccentric grinder according to FIG. 5, which is driven to perform orbital movements at a frequency of approximately 2000 to 10000 l/min., preferably 4000 to 8000 l/min. The eccentric throw is equal to approximately 1 to 1.5 mm. Here again, the contact pressure is limited during dry grinding in such a way that an average temperature of approximately 50° Centigrade will not be exceeded. This provides satisfactory security from the risk of stresses being released and/or stress cracks forming in the working area.

The eccentric grinder indicated generally by 10' comprises a grinding tool 12' provided with an abrasive carrier 13' having a circular surface intended to receive an abrasive 16' according to FIG. 2. The abrasive carrier 13' is rigidly connected to a central threaded stem 66, via an intermediate flange 72. The threaded stem 66 is connected to the drive shaft of an eccentric drive not shown in the drawing. Molded on the threaded stem 66, at its side facing the abrasive, is a terminal collar 70 which is sealed by means of a compound in a central receiving opening 68 of the intermediate flange 72 so as to guarantee a rigid, non-rotating connection. Apart from this connection, other connection modes would of course also be possible. Above the intermediate flange 72, there is provided a suction hood 20' whose outer lateral faces 27' project downwardly in the form of a bell in the direction of the abrasive, overlapping in part the lateral faces 43' of the abrasive carrier 13' in such a way that a narrow suction gap is formed between the lateral face 27' of the suction hood 20' and the lateral face 34' of the abrasive carrier 13'. The end face 25' of the suction hood 20', which faces the surface to be worked, is set off from the surface to be worked by a small amount, similar to the arrangement of the embodiment according to FIG. 3.

As indicated in the left half of FIG. 5, the suction hood 20' and the abrasive carrier 13' are screwed together via the intermediate flange 72.

We claim:

1. A dry method for treating the surface of a transparent acrylic glass with an abrasive, comprising the steps of:

moving a mechanically driven grinding tool across said surface of transparent acrylic glass, said grinding tool performing at least one of an orbital movement and an oscillating movement about a fixed rotary axis and using a dry abrasive without any liquid working agent, said abrasive comprising abrasive grains held resiliently on a carrier that is removably attached to said grinding tool;

extracting, from a marginal area of said grinding tool, grinding dust arising from the movement of said abrasive across the transparent acrylic glass surface;

controlling the speed of the grinding tool such that the average speed of the abrasive grains relative to the surface of transparent acrylic glass is in the range of two to twenty meters per second; and controlling the contact pressure between the grinding tool and the surface of transparent acrylic glass such that a surface temperature of approximately 50° Centigrade is not exceeded.

2. A method according to claim 1, wherein a plurality of said resiliently held abrasive grains have substantially level front surfaces which are delimited by relatively sharp edges at a transition to their lateral surfaces, the great part of said front surfaces being oriented to extend substantially in parallel to a surface to be worked.

3. A method according to claim 1, wherein said grinding tool is driven by an eccentric grinder at a frequency of approximately 2000 to 10000 rpm.

4. A method according to claim 1, wherein said carrier has at least one corner area and said grinding tool performs an oscillating movement at a frequency of approximately 10000 to 25000 times per minute about said fixed rotary axis.

5. A method according to claim 4, wherein said abrasive carrier has a generally triangular shape.

6. A method according to claim 3, wherein said eccentric grinder is driven at a frequency of approximately 4000 to 8000 rpm.

7. A method according to claim 3, wherein said eccentric grinder has an eccentric throw of approximately 1 to 1.5 mm.

8. A method according to claim 4, wherein said abrasive projects over any edges provided on said abrasive carrier.

9. A method according to claim 1, wherein said grinding tool is moved across a surface to be worked by a cross-grinding method.

10. A method according to claim 5, wherein said abrasive projects over any edges provided on said abrasive carrier.

* * * * *